US009057582B2

(12) United States Patent
Bjòrkman et al.

(10) Patent No.: US 9,057,582 B2
(45) Date of Patent: Jun. 16, 2015

(54) SIMULATION SYSTEM

(75) Inventors: Ulf Bjòrkman, Jönkoping (SE); Anders Holmquist, Jönköping (SE)

(73) Assignee: SAAB AB, Linköping (SE)

( * ) Notice: Subject to any disclaimer, the term of this patent is extended or adjusted under 35 U.S.C. 154(b) by 1167 days.

(21) Appl. No.: 11/185,687

(22) Filed: Jul. 21, 2005

(65) Prior Publication Data

US 2007/0020585 A1 Jan. 25, 2007

(30) Foreign Application Priority Data

Sep. 7, 2004 (EP) ..... 04021190

(51) Int. Cl.
*F41A 33/00* (2006.01)
*F41G 3/26* (2006.01)

(52) U.S. Cl.
CPC ..... *F41G 3/2655* (2013.01)

(58) Field of Classification Search
CPC ..... F41A 33/00; F41G 3/26
USPC ..... 434/11, 21, 22; 463/5
See application file for complete search history.

(56) References Cited

U.S. PATENT DOCUMENTS 3,898,747 A * 8/1975 Marshall ..... 434/22
4,063,368 A * 12/1977 McFarland et al. ..... 434/22
4,195,422 A * 4/1980 Budmiger ..... 434/20
4,203,232 A * 5/1980 Knight et al. ..... 434/16
4,223,454 A * 9/1980 Mohon et al. ..... 434/20
4,373,916 A * 2/1983 Ashford et al. ..... 434/22
4,629,427 A * 12/1986 Gallagher ..... 434/22
4,695,058 A * 9/1987 Carter et al. ..... 463/5
4,804,325 A * 2/1989 Willits et al. ..... 434/22
5,199,874 A * 4/1993 Campagnuolo et al. ..... 434/11
H1451 H * 6/1995 Campagnuolo ..... 434/11
5,426,295 A * 6/1995 Parikh et al. ..... 250/227.11
5,596,509 A * 1/1997 Karr ..... 235/411
5,788,500 A * 8/1998 Gerber ..... 434/22
5,816,817 A * 10/1998 Tsang et al. ..... 434/22
5,984,788 A * 11/1999 Lebensfeld et al. ..... 463/51
5,993,215 A * 11/1999 Kotsiopoulos et al. ..... 434/21
6,139,323 A * 10/2000 Christians et al. ..... 434/16
6,174,169 B1 * 1/2001 Gerber ..... 434/11
6,254,394 B1 * 7/2001 Draper et al. ..... 434/11
6,398,555 B1 * 6/2002 Gerber et al. ..... 434/22

(Continued)

FOREIGN PATENT DOCUMENTS

DE 19611209 9/1997
EP 0859243 B1 8/1998

*Primary Examiner* — Sam Yao
*Assistant Examiner* — Alvin Carlos
(74) *Attorney, Agent, or Firm* — Venable LLP; Michael A. Sartori; Jeffri A. Kaminski

(57) ABSTRACT

A simulation system for use in military exercise of combat in an area having at least one building has a transmitter arranged on a firearm for simulating firing of a shot and a detector to be arranged on the body of a soldier. Sensors are adapted to sense whether the transmitter and the detector are located indoors or outdoors. The detector is designed to discriminate between normal power signals fired from outdoors and indoors, whereas the transmitters is adapted to emit signals of normal power when located outdoors and signal of normal power as well as a substantially lower power when located indoors.

7 Claims, 2 Drawing Sheets

(56) References Cited

U.S. PATENT DOCUMENTS

| | | | | |
|---|---|---|---|---|
| 6,439,892 | B1 * | 8/2002 | Gerber | 434/11 |
| 6,569,011 | B1 * | 5/2003 | Lynch et al. | 463/1 |
| 6,579,097 | B1 | 6/2003 | Sampson et al. | |
| 6,638,070 | B1 * | 10/2003 | Healy et al. | 434/22 |
| 6,804,466 | B1 * | 10/2004 | Gazzetta et al. | 398/140 |
| 6,863,532 | B1 * | 3/2005 | Ambrosoli | 434/11 |
| 6,935,864 | B2 * | 8/2005 | Shechter et al. | 434/19 |
| 7,052,276 | B2 * | 5/2006 | Davidsson et al. | 434/11 |
| 2001/0029011 | A1 * | 10/2001 | Dagani et al. | 434/11 |
| 2002/0111201 | A1 * | 8/2002 | Lang | 463/2 |
| 2003/0027103 | A1 * | 2/2003 | Preston et al. | 434/11 |
| 2005/0200477 | A1 * | 9/2005 | Lindero | 340/539.13 |
| 2007/0049313 | A1 * | 3/2007 | Grams et al. | 455/517 |
| 2010/0092925 | A1 * | 4/2010 | Lvovskiy et al. | 434/22 |

* cited by examiner

SIMULATION SYSTEM

TECHNICAL FIELD OF THE INVENTION AND PRIOR ART

The present invention relates to a simulation system for use in military exercise of combat in an area having at least one building, said system comprising for a soldier participating in said exercise a shot firing simulating transmitter, such as a laser pulse generator, to be arranged on a firearm and means to be arranged on the body of a said soldier for detecting a hit by a shot simulated by a said transmitter on a firearm of another soldier, as well as a method for simulating combat in an area having at least one building during a military exercise according to the preamble of the appended method claim.

"Combat in an area having at least one building" normally means combat in a village, city or any type of gathering of buildings, but this definition has to be interpreted broadly and includes also combat in an area having only one building. Furthermore, this building does not have to be a conventional house, but it may be for instance a shelter in a rock having openings to the outside, a cave and the like. The important thing is that soldiers participating in the combat may be located and firing their firearms indoors as well as outdoors.

"Firearms" may be any type of firearm that may be carried along by a person, such as a rifle, a pistol and a machine gun, and it may be an automatic, semiautomatic or non-automatic weapon.

As always in a military exercise it is desired to obtain conditions and results of the exercise being as close to a real situation as possible for obtaining a good training result. This requires an adaptation of a simulation system used for a military exercise to the conditions prevailing on the place of the exercise, such as if the exercise takes place in an open landscape, in a city or the like. Thus, it is important to adapt the simulation system to combat in an area having at least one building, such as in a village, when such a combat is a part of a military exercise.

A said transmitter used in a simulation system of this type is either simulating the firing of a shot synchronized with the firing of a blank by said firearm or without any such firing by carrying out a transmission of a signal simulating a projectile fired by the firearm. This transmitter normally emits laser pulse for such a simulation and this particular case will hereinafter be described for illustrative purpose, but such a transmitter may emit any type of signal suitable for the task, such as maybe any type of radio signal, non-audible sound pulse or the like.

A number of problems arise when using a transmitter of this type for simulating combat in an area having at least one building, i.e. in which soldiers may be located indoors as well as outdoors. The signal, such as the laser pulse, may ricochet, i.e. be reflected or deflected, and create unnormal situations, so that a shot missing the target may erroneously be detected as a hit. Furthermore, the beam width or the side lobes of the laser pulses will be too large, so that at short distances a soldier may be hit by such light within such a side lobe being strong enough for detection of a real hit although the target was missed by the shot. An approach to solving this problem is to reduce the range of the firearm by making the detecting means less sensitive or by lowering the power of said signals, such as the laser pulses. Furthermore, in a combat of this type soldiers are often fighting at short distances, perhaps as short as 1.5 m, and said laser pulse generators (transmitters) are normally made to shoot accurately at larger distances, so that it is desired to shorten the range thereof.

However, a number of non-realistic effects occur when the power of said signals emitted is simply reduced or the sensitiveness of the detecting means is simply lowered. This is the case when soldiers located indoors are fighting against soldiers located outdoors. For example, when a soldier located indoors is shooting with such a reduced power towards a soldier located outdoors at a distance from a building a hit may not be detected.

SUMMARY OF THE INVENTION

The object of the present invention is to provide a simulation system and a method of the type defined in the introduction, which makes it possible to simulate a combat in an area having at least one building during a military exercise to be closer to a combat with live ammunition in a real situation than such systems and methods already known.

This object is according to the invention obtained by providing a simulation system and a method according to the appended independent corresponding claims.

Thus, the invention rely on sensing whether said transmitter and said detecting means are located indoors or outdoors and adapting the function of said transmitter and detecting means thereto. Accordingly, a soldier located outdoors will be able to reach and hit a soldier located in a building through firing through for example a window, since he is firing with normal power and the detecting means of the soldier indoors will detect such a signal coded to come from outdoors. Furthermore, the soldier located indoors may shoot against and hit the soldier located outdoors, since the signals of said second type having a normal power may reach the detecting means of the soldier located outdoors and be detected thereby. At the same time, such signals of the second type having normal power may not be considered as a hit when a soldier located indoors is firing against another soldier located indoors and missing the latter even if such signals ricochet against said detecting means, since the code thereof will tell the detecting means to disregard this signal. This means that the soldier located indoors may only hit another soldier located indoors by a real hit obtained by a signal of said third type being of a substantially lower power, since said side lobes are also reduced in width with reduced power also avoiding erroneous detection of hits through side lobe signals reaching the detector of a soldier shot at. This all together creates a situation in the military exercise of combat in an area having at least one building being very realistic.

Although it would mostly be appropriate to provide all the participants of a said military exercise with both a said transmitter and a said detecting means, normally in the form of a vest carried by a person, it is also within the scope of the invention to let some of the participants being unarmed and only carrying a said detecting means.

According to an embodiment of the present invention said transmitter is adapted to code also said signals of said third type to coming from the soldier located indoors. This may be important for a later evaluation of the military exercise through data processing, since this improves the possibilities to discriminate between hits emanating from firearms of different soldiers.

According to another embodiment of the invention the simulation system comprises a central network that is arranged to receive/send/store and/or communicate information concerning the state of participants in a said military exercise by communicating with said transmitters and/or detecting means included in said simulation system. Such a central network is advantageous for governing the military exercise as well as for later evaluation thereof for learning thereby.

According to another embodiment of the invention the simulation system comprises calculation means associated with said detecting means to provide an assessment of injury/damage that would have been caused by a said hit detected by the detecting means in a real situation, which makes it possible to determine the result of said hit, which may be that the soldier in question is considered as dead, unable to move but still firing or the like.

According to another embodiment of the invention said calculation means contain a range of action data for each said firearm versus distance of participants in a military exercise from such a firearm in order to assess the degree of injury/damage that would have been caused by a said hit detected by the detecting means in a real situation for making the exercise more realistic.

The function of the method according to the appended independent method claim as well as the goals obtained thereby appear from the above description of the simulation system according to the invention.

The invention also comprises a computer program to be used in a simulation system according to the invention as well as a use of a simulation system according to the invention in a military exercise of combat according to the corresponding appended claims.

Further advantages as well as advantageous features of the invention will appear from the following description and the other dependent claims.

BRIEF DESCRIPTION OF THE DRAWINGS

With reference to the appended drawings, below follows a specific description of an embodiment of the present invention cited as an example. In the drawings.

DETAILED DESCRIPTION OF AN EMBODIMENT OF THE INVENTION

Figure 1:
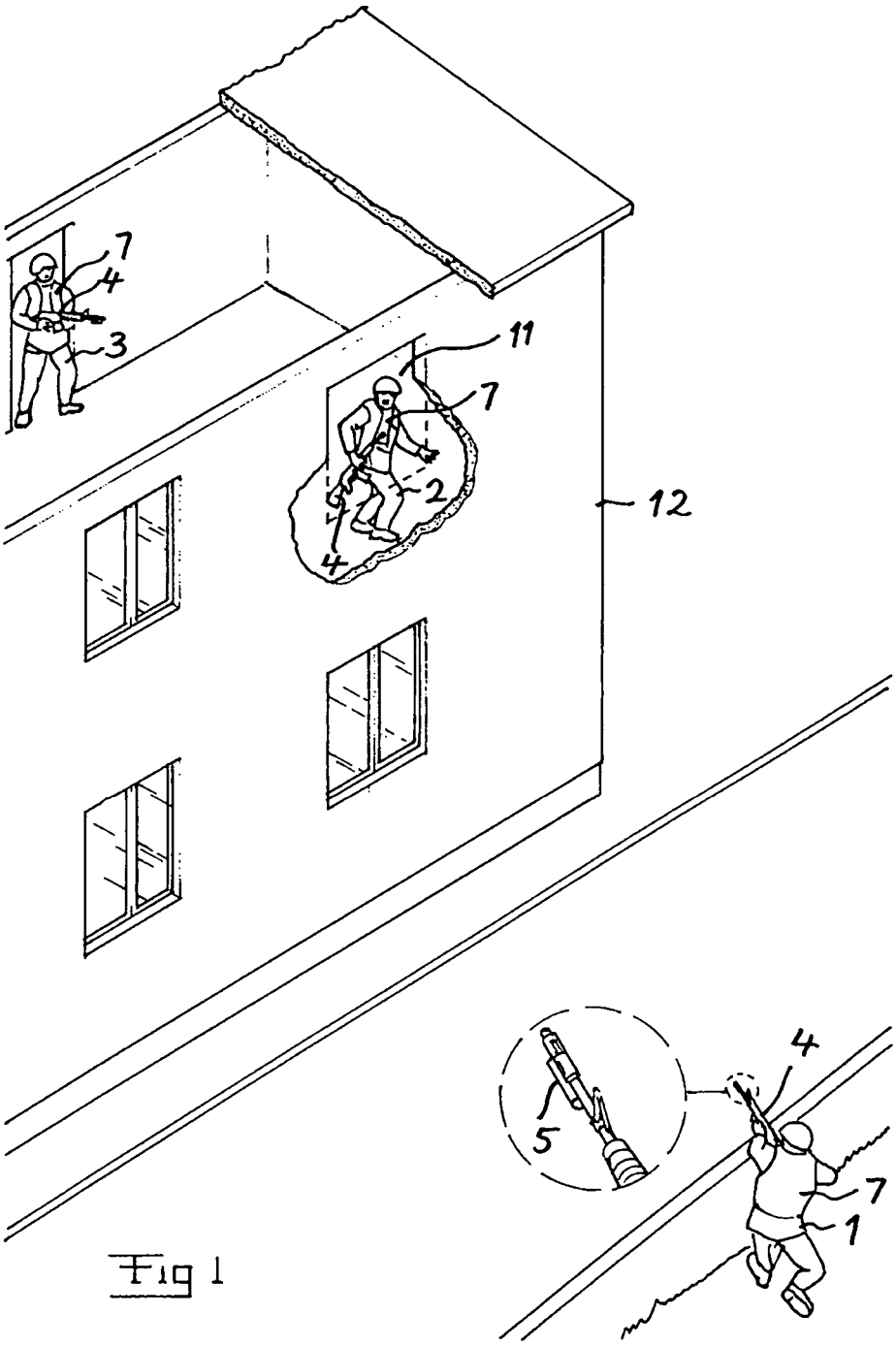
FIG. 1 is a very schematic view illustrating a combat in an area having at least one building in a military exercise using a simulation system according to the invention.

A military exercise taking place in an area having at least one building, in this case a village, while using a simulation system according to the invention is schematically illustrated in FIG. 1. In the following, reference is also made to FIG. 2. Each soldier 1-3 participating in the exercise has here a firearm 4 onto which a transmitter 5, in this case a laser pulse generator, is arranged for emitting a shot firing simulating signal when a blank is shot by the firearm. The transmitter is connected to means 6 adapted to sense whether the transmitter is located indoors or outdoors.

The means 6 adapted to sense whether the transmitter is located indoors or outdoors is in one example arranged to sense a signal sequence from a transmitter arranged indoors, wherein the transmitter can include a light source such as a laser whose generated light lies in a wavelength range being adapted to the application in question and whose generated light is delimited in space by the walls defining the indoor area. Arbitrary other signal format with similar characteristics may of course likewise be used. In one alternative example the means 6 are arranged to sense radio signals from at least two radio transmitters and to perform position determination based on said radio signals using known triangulation methods.

The transmitter 5 is upon firing of a shot by a firearm 4 adapted to emit signals of a first type being of normal power and coded to coming from a soldier located outdoors, when the sensor indicates that the transmitter is located outdoors, and when located indoors emit signals of a second type being of normal power as well as of a third type being of a substantially lower power. At least the signals of the second type are coded to coming from a soldier located indoors.

The soldiers are also provided with means 7 in the form of a target vest to be arranged on the body of a soldier for detecting a hit by a shot simulated by a said transmitter 5 on a firearm 4 of another soldier. Means 8 adapted to sense whether said detecting means is located indoors or outdoors are also associated with each detecting means. The detecting means is adapted to decode signals received from any transmitter 5 and when located outdoors detect at least signals of said first and said second type, i.e. signals of normal power emitted outdoors or indoors, as a hit and when located indoors only signals of said first and third type, i.e. signals of normal power emitted outdoors or signals of a substantially lower power emitted indoors, as a hit and disregard signals of said second type, i.e. signals of normal power emitted indoors.

The table following below indicates this function of the transmitter and the detector. The numbers 1, 2 and 3 correspond to signals of said first, second and third type, respectively.

TABLE

| Transmitter | Detector Code | Outdoors 1, 2 | Indoors 1, 3 |
|---|---|---|---|
| outdoors | 1 | 1 | 1 |
| indoors | 2, 3 | 2 | 3 |

Furthermore, said detecting means 7 is adapted to only detect signals having a power/intensity above a predetermined threshold for excluding signals reflected by objects near a soldier to be detected as a hit.

"A substantially lower power" means in this context a power being at least less than 50% of said normal power, preferably less than 10% of the normal power.

The transmitters are preferably adapted to emit signals in the form of light pulses, such as laser pulses, within the infrared range, so that they may not be seen by the soldiers.

Figure 2:
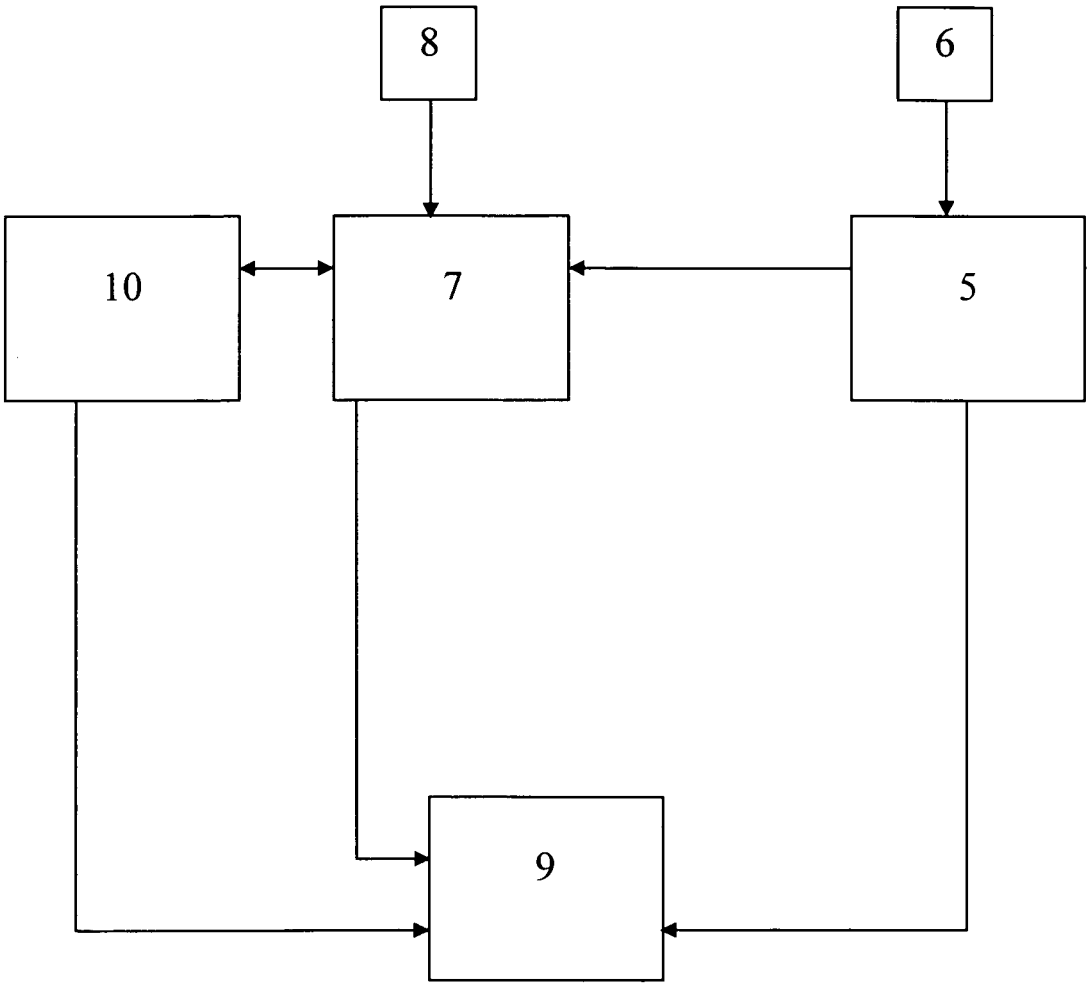
FIG. 2 is a schematic diagram illustrating the function of a simulation system according to the invention.

It is schematically illustrated in FIG. 2 how the simulation system may comprise a central network indicated by 9 arranged to receive/send/store and/or communicate information concerning the state of participants in a said military exercise by communicating with said transmitters 5 and/or detecting 7 means included in the simulation system. The system also comprises calculation means 10 associated with the detecting means 7 to provide an assessment of injury/damage that would have been caused by a said hit detected by the detecting means in a real situation. Such means adapted to evaluate an injury/damage assessment are arranged to be carried by the participants in a said military exercise carrying a detecting means. The function of the detecting means and/or the calculation means is preferably accomplished by means of a computer program according to the invention.

The features of a simulation system according to the invention as described above will in a combat situation illustrated in FIG. 1 have the following result: when the soldier 1 located outdoors is shooting through a window 11 of the building 12 towards a soldier 2 located indoors signals of the normal power will be emitted by the transmitter 5 and detected as a hit by the detecting means 7 of the soldier 2 when this is hit thereby. When the soldier 2 located indoors is shooting through the window 11 towards the soldier 1 located outdoors signals of normal power and signals of a substantially lower power will be emitted by the transmitter of the soldier 2, and these signals will be coded to coming from a soldier located indoors. The signals of normal power will be detected as a hit when the detecting means of the soldier 1 outdoors will be hit. Furthermore, the soldier 2 located indoors is also attacked by a soldier 3 located indoors and these are shooting towards each other. The detecting means 7 of these soldiers will disregard signals of normal power coded to coming from a soldier located indoors and among signals emitted from a transmitter located indoors only detect such signals of a substantially lower power as a hit when hit thereby. This means that a direct hit is necessary for detecting a hit, and it is not possible to obtain a hit by ricocheting of signals of normal power missing the target.

Accordingly, a very realistic combat in an area having at least one building with soldiers located indoors as well as outdoors may be simulated in a military exercise using the simulation system according to the invention. The key of the present invention is:

1. To enabling discriminating between normal power signals fired from outdoors and indoors by said detecting means, and 2. To emit shot firing simulating signals of reduced power for indoors fighting.

The invention is of course not in any way restricted to the embodiment shown and described above.

It is pointed out that the sensing means for the transmitter and the detecting means of one and the same soldier may often be the same, normally a sensor in common arranged on a vest carried by the soldier.

It is also within the scope of the invention to let some of the participants of a military exercise carry firearms only used outdoors and for that sake not provided with any indoors/outdoors-sensor or any possibility to code the signals emitted by the transmitter thereof.

"coded to coming from a soldier located outdoors" is to be interpreted to also comprise that these signals do not have any code, but since the signals of said second type are coded to coming from a solider located indoors the signals of the first type may be distinguished therefrom and may after all be considered to be coded to coming from a soldier located outdoors. The important thing is that signals of said second type may be distinguished from signals of said first and third type by a detecting means of a soldier located indoors. Accordingly, this may also be achieved by coding said first and third type signals but not the second type signals being then indirectly coded.

The invention claimed is:

1. A combat simulation system, comprising:

a shelter;

at least one shot firing simulating transmitter arranged on weapon and configured to produce a simulated shot;

at least one hit detector arranged on target and configured to detect the simulated shot;

an injury/damage assessment calculator configured to a calculate a damage/injury assessment by the simulated shot;

a sensor arranged on at least one weapon and configured to determine whether the at least one shot firing simulating transmitter is located within the shelter, wherein a power/intensity of the simulated shot varies based upon the determined location of the at least one weapon, and wherein the simulated shot will be coded according to the determined location, a firing shot simulating transmitter determined to be outside the shelter transmits a shot having a first power/intensity, and a firing shot simulating transmitter determined to be inside the shelter transmits a shot having the first power/intensity and a shot having a second power that is at least 50% lower power than the first power/intensity;

a second sensor in communication with the at least one hit detector to determine whether the at least one hit detector is located within the shelter; and a central network to which the at least one shot firing simulating transmitter, at least one hit detector, and injury/damage assessment calculator are connected, and wherein the hit detector receives the determined location from the second sensor, decodes the shot received from the transmitter and when the determined location of the hit detector is outside the shelter to detect at the shot having the first power/intensity as a hit and when the determined location is inside the shelter to only detect the shot having the first power/intensity and coded as outside the shelter or a shot having the second power as a hit and disregard the shot having the first power/intensity and coded as being inside the shelter, and the hit detector is adapted to exclude signals reflected by objects to be detected as a hit.

2. A simulation system according to claim 1, wherein said transmitter is adapted to emit signals in the form of light pulses within the infrared range.

3. A simulation system according to claim 1, wherein said transmitter is adapted to emit signals in the form of laser pulses.

4. A simulation system according to claim 1, wherein said detector is adapted to only detect said having a power/intensity above a predetermined threshold for excluding signals reflected by objects near a soldier, to be detected as a hit.

5. A system according to claim 1, wherein the calculator is arranged to be carried by any or all of the participants in a said military exercise.

6. A simulation system according to claim 1, wherein the detector is adapted to only detect signals having a power or intensity above a predetermined threshold to exclude signals.

7. A simulation system according to claim 1, wherein the second power is less than 10% of the normal power.

* * * * *